United States Patent [19]

Fidi

[11] Patent Number: 5,033,086

[45] Date of Patent: Jul. 16, 1991

[54] STEREOPHONIC BINAURAL RECORDING OR REPRODUCTION METHOD

[75] Inventor: Werner Fidi, Baden, Austria

[73] Assignee: AKG Akustische u. Kino-Geräte Gesellschaft m.b.H, Vienna, Australia

[21] Appl. No.: 426,797

[22] Filed: Oct. 24, 1989

[30] Foreign Application Priority Data

Oct. 24, 1988 [AT] Austria ..... 2635/88

[51] Int. Cl.[5] ..... H04R 5/00

[52] U.S. Cl. ..... 381/25

[58] Field of Search ..... 381/1, 25, 26

[56] References Cited

U.S. PATENT DOCUMENTS

| | | | |
|---|---|---|---|
| 3,916,104 | 10/1975 | Anazawa et al. | 381/26 |
| 4,068,093 | 1/1978 | Fidi | 381/17 |
| 4,097,689 | 6/1978 | Yamada et al. | 381/25 |
| 4,589,128 | 5/1986 | Pfleiderer | 381/25 |
| 4,603,429 | 7/1986 | Carver | 381/1 |
| 4,910,779 | 3/1990 | Cooper et al. | 381/26 |

FOREIGN PATENT DOCUMENTS 3112874 12/1983 Fed. Rep. of Germany .

2122459 1/1984 United Kingdom .

*Primary Examiner*—Forester W. Isen

*Attorney, Agent, or Firm*—Toren, McGeady & Associates

[57] ABSTRACT

A stereophonic binaural recording and reproduction method for audio signals presented to headsets. Signals of the left stereo channel are supplied to the left ear, weighted with the outer ear transmission function of the left ear for the angle range of between 0° to 45° to the left of the median plane, and to the right ear, weighted with the outer ear transmission function of the right ear for the same angle range. Additionally, time-delayed signals of the left stereo channel are supplied to the right ear, weighted with the outer ear transmission function of this ear for the opposite angle range, wherein the delay is markedly outside of the time range of the sum localization and of the audible echo. The signals of the right stereo channel are supplied to the right and left ear in the same manner but mirror-inverted relative to the median plane. Any necessary equalizations of the amplitude-frequency characteristic are carried out without influencing the time structures by means of linear phase digital filters on the outer ear transmission functions.

5 Claims, 2 Drawing Sheets

STEREOPHONIC BINAURAL RECORDING OR REPRODUCTION METHOD

BACKGROUND OF THE INVENTION

1. Field of the Invention

The present invention relates to a stereophonic binaural recording or reproduction method for audio signals presented to headsets.

2. Description of the Related Art

Many stereophonic recording and reproduction methods seek to provide at the audiotory location the true auditive originality of the listening event prevailing at the recording location.

German Offenlegungsschrift 31 12 874 describes one of the methods for reproducing a sound recording and a device for carrying out the reproduction. This method makes it possible to obtain a spatial sound reproduction which is perceived to be very natural, particularly when headsets are used as the reproduction device. The method is based on supplying the sound recording to the reproduction apparatus through a reverberation producing unit which produces reverberation reflections within a period of time of approximately 50 ms after the direct sound pulse has arrived. The reverberation reflections are produced in time intervals, preferably over 2 ms, such that they are still perceived by perceived by the listener as individual reflections of strong sound. At least some of the individual reflections consist of two pulses which are separated by a direct sound pulse from a channel of the sound carrier. The first of these pulses is emitted through a channel of the reproduction apparatus which is assigned to the corresponding sound carrier channel and the second pulse is somewhat weaker and is emitted with a time delay of approximately 0.2 ms to 1 ms, preferably to 0.63 ms, relative to the first pulse through the other channel of the reproduction apparatus, wherein the reverberation reflections are attenuated in dependence on the sound frequency.

The above-described method, which is also called real time stereophony, is based on the recognition that sound fields cannot easily be transferred in their original spatial distribution to a listening room which differs from the recording room. Particularly in the case of headset reproduction in which no acoustic listening room is involved, an electroacoustically reconstructed sound field must be presented in accordance with psychoacoustic considerations. The sound material used for this purpose is spatially defined at least with respect to its recording. Thus, this method makes it possible to obtain in the reproduction a remarkable spatial effect and excellent transparency of the sound occurrence, primarily of the music occurrence, because the essential sound which is reflected having first once encountered one of the walls enclosing the room and then finally having encountered more than one wall is reconstructed in the acoustically correct time interval with subsequent reverberations. However, this method does not solve the problem of incorrect localization of the auditory event.

It is, therefore, the primary object of the present invention to provide a method for the stereophonic binaural recording or reproduction of audio signals which provides the true auditive originality at the auditory location and which, most importantly, makes possible a clear and correct localization of certain sound sources.

SUMMARY OF THE INVENTION

In accordance with the present invention, the signals of the left stereo channel are supplied to the left ear, weighted with the transfer function of the external ear of the left ear for the angle range of between 0° and 45° to the left of the median plane, and to the right ear, weighted with the transfer function of the external ear of this ear for the same angle range. Additionally, time-delayed signals of the left stereo channel are supplied to the right ear, weighted with the transfer function of the external ear of this ear for the opposite angle range, wherein the delay is markedly outside of the range of the summing localization and of the audible echo, i.e., between 5 ms and 80 ms. The signals of the right stereo channel are supplied to the right and left ear in the same manner but mirror-inverted relative to the median plane. Any necessary equalizations of the amplitude-frequency characteristic are carried out without influencing the time structures by means of linear phase digital filters on the respectively used outer ear transmission functions.

The essence of the invention resides in that locating certain sound sources within an auditory space is primarily possible because, during the processing in the brain of all individual sound events perceived by the ear, the first reflection from the mirror sound source is of particular significance.

Generally, hearing with respect to direction and distance is acoustically determined on the basis of the transfer function of the external ear. For the final determination of direction and distance, the brain additionally utilizes in the manner of a computer the optical impressions received by the eyes, as well as rotating movements, tipping movements and probing movements of the head, in order to determine the actual spatial-acoustic situation. Added to this may be already existing known facts concerning the signals. In order to place all these perceptions in logical relationships, the brain requires a long-term storage and a short-term storage wherein the short-term storage is always adjusted to the newly prevailing actual situation. When contradictory perceptions occur, for example, when the optical impression does not coincide with the spatial situation, the audio signal is located in the rear. This may be explainable as a certain protective function of the person.

In accordance with the invention, a normal sound recording existing for stereophonic loudspeaker reproduction is presented through headsets as closely as possible to the original if, in addition to the directly arriving audio signals of the two channels on the left and the right, additionally the sound which is reflected having first once encountered one of the walls enclosing the room and then finally having encountered more than one wall is reconstructed, but weighted with the directionally dependent transfer function of the external ear. The integration of the transfer function of the external ear over all spatial directions results in an approximately flat amplitude frequency response at the ear. However, such a complex reconstruction is practically impossible. Therefore, a simplified configuration must be used.

This significantly simplified configuration, which ensured correct and accurate results, was obtained from a large number of listening tests. This means that it is only necessary to supply to each ear three different audio signals in order to guarantee a listening event which is true to natural origin.

In accordance with a further development of the invention, the necessary equalization is carried out as an inverse linear-phase sum formation of the transfer function of the external ear for each ear.

In order to ensure the true auditive originality, two further problems must be especially taken into consideration:

1. The equalization or removal of distortions of the presented audio signals, and 2. Any individual references in the transfer function of the external ear of different persons must be taken into consideration.

Since audio signals are presented to each ear only from three directions, the sum of these signals do not result in a flat amplitude frequency response. The very different frequency response with respect to the amplitude pattern results in distortions of the tone color. This problem is solved by summing the transfer function of the external ear for each ear and subsequently multiplying each individual outer ear transmission function with the inverse linear-phase sum transfer function of the external ear. As a consequence, the following is achieved: First, the tone colors are maintained because the sum of the amplitude frequency response is even and, second, the phase structures and, thus, also the time structures of the audio signals are not influenced, so that especially the directional hearing in the forward angle range of ±60° (to the left and right of the median plane) is not influenced.

The problem of differences between individual persons cannot be completely solved. The linear-phase equalization of the transfer function of the external ear equalizes the individual variations of amplitude frequency characteristics. However, the differences are maintained in the individual phase structures. Accordingly, the only choice is to use the transfer function of the external ear of an "average person" who is as representative as possible or to offer the transfer function of the external ear of "different persons". The finally remaining reference to the choice which comes closest to the individual listening behavior can only be compensated by means of the individual listener's learning capabilities.

Of course, the best listening results are obtained with the "own ears", i.e., using the own transfer function of the external ear. In a practical listening test it was found that test persons were unable to distinguish any longer during hearing with "other ears" with fixed heads whether the audio signals were presented through loudspeakers or headsets. While front/rear direction inversions did occur in the loudspeaker presentation as well as in the headset presentation, the known localization in the head did not occur in any of the cases.

In accordance with an advantageous feature of the invention, the left stereo signals supplied to the right ear, weighted with the transfer function of the external ear of the right ear for the angle range 0° to 45° to the left of the median plane, and the right stereo signals supplied to the left ear, weighted with the transfer function of the external ear of the left ear and for the angle range 0° to 45° to the right of the median plane, are also subjected to a time delay which may be up to a maximum of 700 μs.

A time delay of the above-mentioned audio signals has a supportive effect on the interaural signal differences and, thus, reinforces the total effect of the method of the invention, or it can also be used signal-related for regulating the base width.

Finally, another further development of the invention provides that the left stereo signals supplied to the right ear, weighted with the transfer function of the external ear of the right ear for the angle range of 0° to 45° to the left of the median plane, and the right stereo signals supplied to the left ear, weighted with the transfer function of the external ear of the left ear for the angle range of 0° and 45° to the right of the median plane, are offered together with the already originally always time-delayed signals, within the above-mentioned time ranges alternatingly in pairs with different delays.

The differences in the time delays of the individual stereo signals take into consideration geometric asymmetries of the human head and of the listener relative to his location within a room which is surrounded with walls. This best realizes the naturalness of the presented listening event. Particularly favorable delay times for the interaural signal portion have been found to be, for example, approximately 0.3 ms for the left ear and approximately 0.4 ms for the right ear. The corresponding delay times of a mirror sound source are then to be selected at approximately 27 ms for the left ear and approximately 22 ms for the right ear. Other combinations are conceivable, however, they will depend on individual conditions.

The method according to the invention can be used on the recording side as well as on the reproduction side. Some questions must still be solved with respect to the compatibility of this method with the production of the presented audio signals through loudspeakers.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
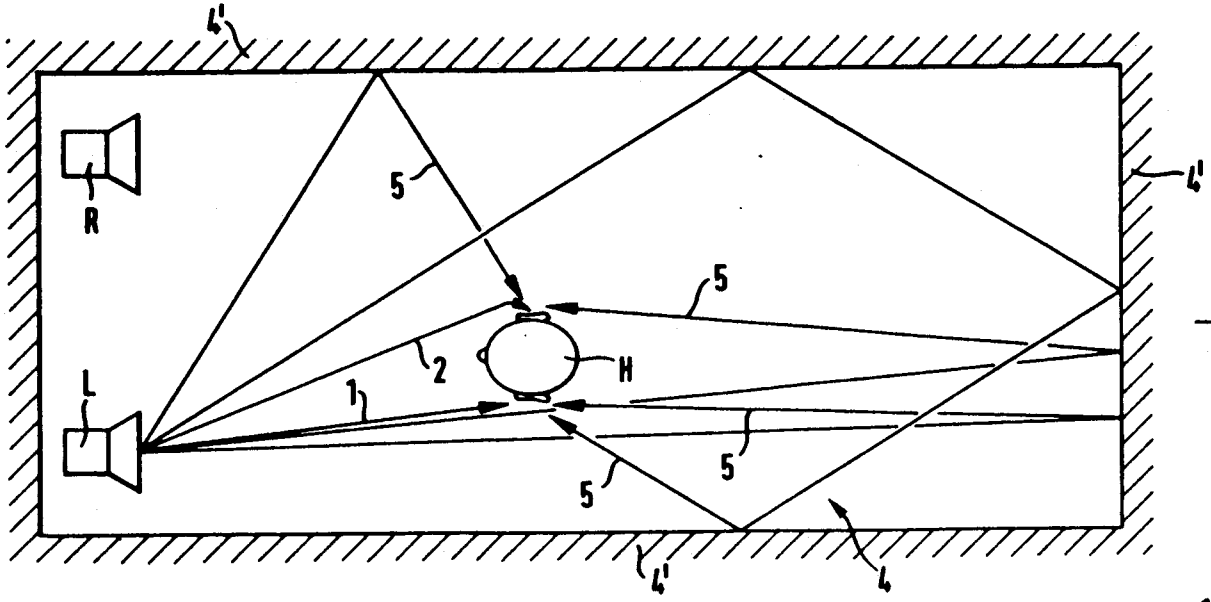
FIG. 1 is a schematic view of the listening conditions in a closed, reflecting room.

In the drawing, FIG. 1 shows the sound conditions existing during stereophonic hearing in a closed room 4 which is provided at sound-reflecting walls 4'. Sound waves or audio signals emanating from the left loudspeaker L reach the left ear and the right ear of the listener H on the direct path 1, 2 as well as through reflections of the auditory space 4 at the walls, floor and ceiling. The same is true in the same manner and simultaneously for the right loudspeaker R. Each direction is weighted with the respective transfer function of the external ear. The portion of the lateral reflections and of the reflections from the ceiling essentially impart the spatial effect, and the primary signals arriving at the ear directly from the two loudspeakers impart the direction from which the presumed sound event emanates. In accordance with the law of summing localization and the first wave front, the ear performs the directional interpretation.

However, in accordance with the invention, the first reflection from the direction of a mirror sound source laterally from behind or entirely from behind plays a very important supportive roll for the directional hearing. The entire transfer function of the external ear is integrated by the ear over all spatial directions as a flat amplitude frequency response. Such a complex reconstruction is almost impossible in practice. Therefore, the method of the present invention utilizes a significantly simplified configuration of those sound portions which contribute significantly to the directional hearing.

Figure 2:
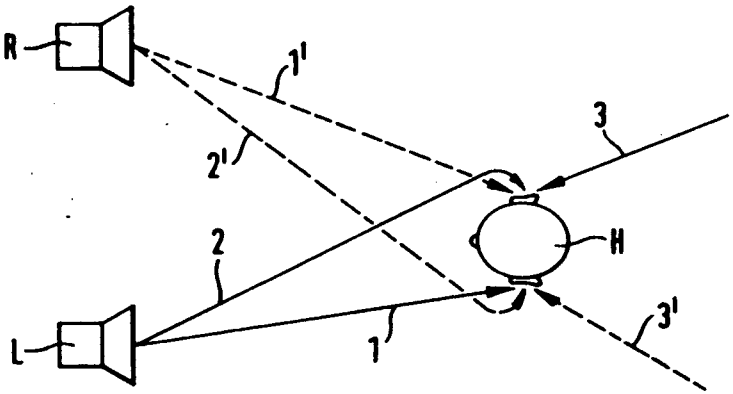
FIG. 2 is a schematic view of the sound portions required for hearing with true originality.

FIG. 2 of the drawing shows the sound portions which significantly contribute to the directionally accurate hearing. A sound event radiated by the left loudspeaker L reaches the left ear on the shortest possible sound path 1 and a sound event radiated by the right loudspeaker R reaches the right ear on the shortest possible sound path 1'. Due to the interaural time difference and distortions resulting from the head, the signal of the left loudspeaker L reaches the right ear on the sound path 2 and the signal of the right loudspeaker R reaches the left ear on the sound path 2'. Thus, the laws of summing localization and first wave front are met. However, this does not clearly guarantee the directionally accurate hearing, primarily in live rooms. The directional accuracy is only ensured with the third signal 3, 3' provided according to the present invention which corresponds to the reflection from a mirror sound source.

Figure 3:
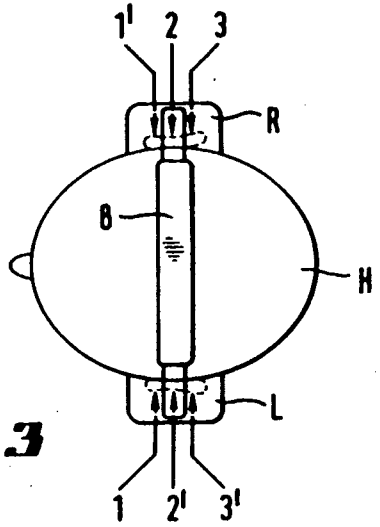
FIG. 3 illustrates the audio signals required for hearing with true originality through headsets.

When these three signals are offered to the ear through headsets 8 weighted with the transfer function of the external ear of the respective directions, as shown in FIG. 3, wherein the three essential signals for the left and the right ear are again denoted by reference numerals 1, 2', 3' and 1', 2, 3, respectively, the problems of the correct equalization and the individually different transfer function of the external ear of different persons must not be disregarded.

Figure 4:
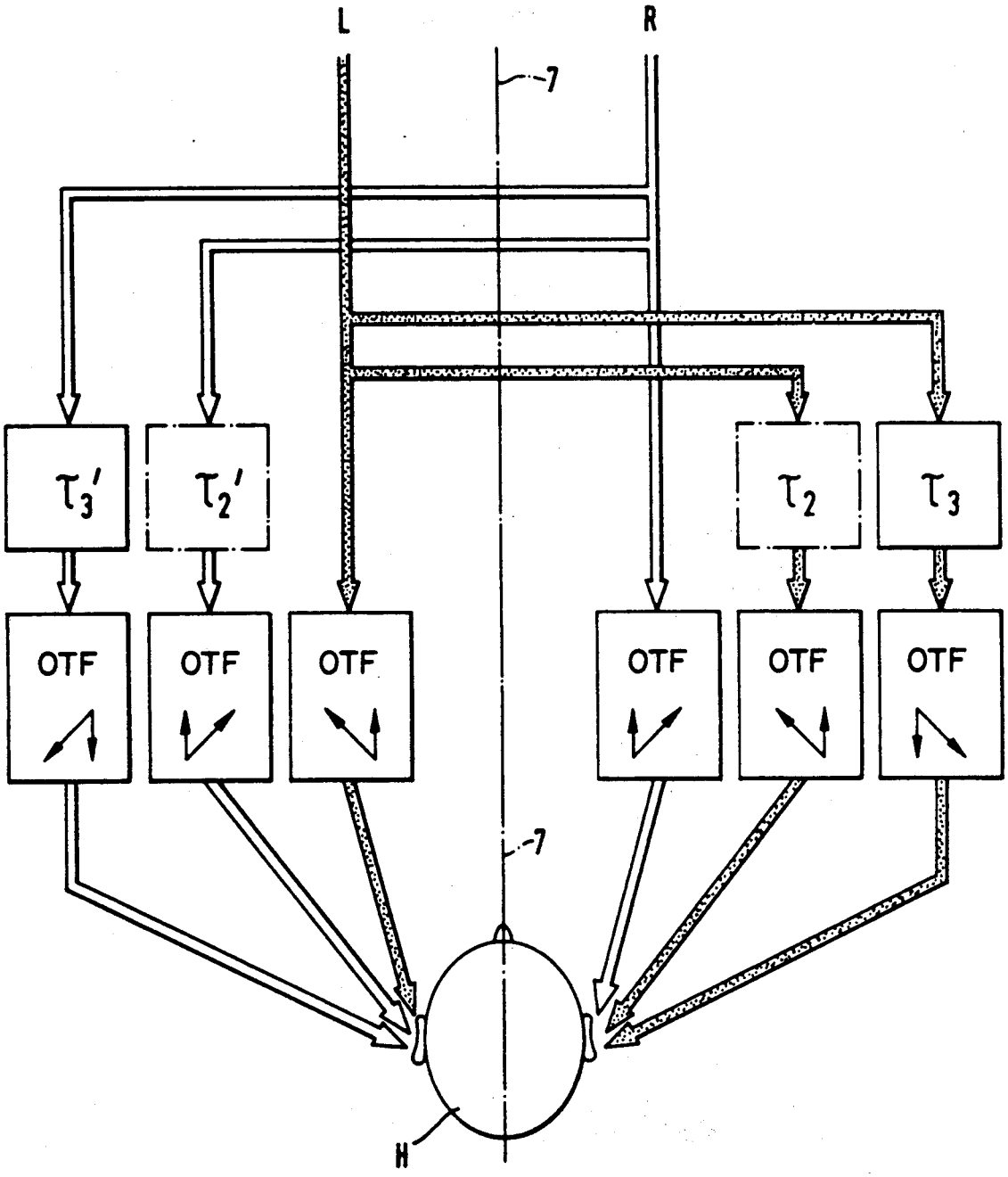
FIG. 4 schematically illustrates the audio signals to be offered to the ear in accordance with the present invention, including the means required for carrying out the method.

The method according to the invention for preventing stereophonic binaural audio signals through headsets is illustrated in FIG. 4. Initially, the audio signals of the left stereo signal L is directly supplied to the left ear, weighted with the transfer function of the external ear of the left ear for the angle range 0° to 45° to the left of the median plane 7, as denoted in FIG. 4 by box OTF which includes the arrows showing the appropriate directions. The same audio signal reaches the right ear through two time-delayed branches. In one of the branches, the time delay $\tau_2$ is a maximum of 700 $\mu$s, wherein the audio signal is weighted with the transfer function of the external ear of the right ear for the angle range 0° to 45° to the left of the median plane 7. This branch takes the interaural hearing into consideration.

In the second time-delayed branch, the delay times $\tau_3$ are between 5 ms and 80 ms, weighted with the transfer function of the external ear from the opposite angle range for the right ear. The weighting with the corresponding transfer function of the external ear is indicated in the drawing by the boxes OTF showing the appropriate directional arrows. The same is true for the audio signal of the right stereo signal R for the right and left ears, but mirror-inverted relative to the median plane 7. In this case, the time delays are denoted by $r'_2$ and $r'_3$.

The directional orientation is increased by presenting the individual time delays unevenly in pairs. For example, $\tau_3$ may be selected at 27 ms and $\tau_2$ may be selected at 0.3 ms; in this situation, it would be advantageous to select $\tau'_3$ at 22 ms and $\tau'_2$ at 0.4 ms.

It would not be useful to present another time-delayed audio signal, which would simulate a mirror sound source as a first echo, to the left ear in addition to the right ear and vice-versa, because this additional audio signal leads to acoustic blocking of the ears and, thus, renders the effect obtainable with the method ineffective. FIG. 4 does not illustrate the necessary linear-phase equalization which maintains the tone colors and leaves uninfluenced the phase structures of the outer ear transmission function.

While a specific embodiment of the invention has been shown and described in detail to illustrate the application of the inventive principles, it will be understood that the invention may be embodied otherwise without departing from such principles.

I claim:

1. A stereophonic binaural recording and reproduction method for audio signals presented to headsets, comprising supplying signals of a left stereo channel to the left ear of a listener, the signals being weighted with a transfer function of the external ear of the left ear for an angle range of between 0° and 45° to the left of a median plane, and to the right ear of the listener, the signals being weighted with a transfer function of the external ear of the right ear for an angle range of between 0° and 45° to the right of the median plane, supplying additional time-delayed signals of the left stereo channel to the right ear, the additional signals being weighted with a transfer function of the external ear of the right ear for the left angle range, wherein the delay is substantially outside of the time range of the summing localization and of the audible echo, and supplying signals of a right stereo channel to the right ear of the listener, the signals being weighted with a transfer function of the external ear of the right ear for an angle range of between 0° and 45° to the right of the median plane, and to the left ear of the listener, the signals being weighted with a transfer function of the external ear of the left ear for an angle range of between 0° and 45° to the left of the median plane, supplying additional time-delayed signals of the right stereo channel to the left ear, the additional signals being weighted with a transfer function of the external ear of the left ear for the right angle range, wherein the delay is substantially outside of the time range of summing localization and of the audible echo.

2. The method according to claim 1, wherein each time range is between 5 ms and 80 ms.

3. The method according to claim 1, wherein necessary equalization is carried out as an inverse linear-phase sum formation of the outer ear transmission function for each ear.

4. The method according to claim 1, wherein the left stereo signals supplied to the right ear, weighted with a transfer function of the external ear of the right ear for the angle range of 0° to 45° to the left of the median plane, and the right stereo signals supplied to the left ear, weighted with a transfer function of the external ear of the left ear for the angle range 0° to 45° to the right of the median plane, are also subjected to a time delay of up to a maximum of 700 μs.

5. The method according to claim 2, wherein the left stereo signals supplied to the right ear, weighted with the transfer function of the external ear of the right ear for the angle range of 0° to 45° to the left of the median plane, and the right stereo signals supplied to the left ear, weighted with the transfer function of the external ear of the left ear for the angle range 0° to 45° to the right of the median plane, are alternatingly offered, together with the time-delayed signals, within said time range with different delays.

* * * * *

UNITED STATES PATENT AND TRADEMARK OFFICE

CERTIFICATE OF CORRECTION

PATENT NO. : 5,033,086

DATED : July 16, 1991

INVENTOR(S) : Werner Fidi

It is certified that error appears in the above-identified patent and that said Letters Patent is hereby corrected as shown below:

On the title page, Item [73] Assignee should read: --AKG Akustische u. Kino-Gerate Geselleschaft m.b.H, Vienna, Austria--.

Signed and Sealed this

Sixth Day of April, 1993

*Attest:*

STEPHEN G. KUNIN

*Attesting Officer*

*Acting Commissioner of Patents and Trademarks*